US006102663A

United States Patent [19]

Wang

[11] Patent Number: 6,102,663

[45] Date of Patent: Aug. 15, 2000

[54] SUSPENSION ASSEMBLIES FOR CEILING FANS

[76] Inventor: Yuh-Shyong Wang, P.O. Box 63-247, No. 5, Lane 30, Ta Chou Road, Shern Gang Hsiang,Taichung Hsien, Taiwan

[21] Appl. No.: 09/145,855

[22] Filed: Sep. 2, 1998

Related U.S. Application Data

[63] Continuation-in-part of application No. 08/885,264, Jun. 30, 1997, Pat. No. 5,851,107.

[51] Int. Cl.[7] ..... I04D 29/64

[52] U.S. Cl. ..... 416/244 R; 416/5; 403/114

[58] Field of Search ..... 416/244 R, 5; 403/114, 115, 122; 248/343; 362/96

[56] References Cited

U.S. PATENT DOCUMENTS

| | | | |
|---|---|---|---|
| 4,634,345 | 1/1987 | Stanek et al. | 416/244 R |
| 5,851,107 | 12/1998 | Wang | 416/5 |
| 5,899,663 | 5/1999 | Feder et al. | 416/5 |

*Primary Examiner*—Edward K. Look
*Assistant Examiner*—Richard Woo
*Attorney, Agent, or Firm*—Charles E. Baxley, Esq.

[57] ABSTRACT

A suspension assembly for ceiling fans includes an upper supporting device securely attached to a ceiling, a suspension rod, and a motor casing. The upper supporting device includes a bowl-like upper retaining seat having a bowl-like spherical inner periphery and a through hole extending along a longitudinal axis thereof. A bowl-like upper suspension member is securely mounted to an upper end of the suspension rod and securely retained in the upper retaining seat. An inverted bowl-like lower suspension member is securely mounted to a lower end of the suspension rod. The motor casing includes an upper casing and a lower casing securely attached to the upper casing. The upper casing includes a lower retaining seat integrally formed on an upper part thereof. The lower retaining seat includes an opening in an upper end thereof for securely holding the lower suspension member. The lower retaining seat further includes a wave-like inner surface to retain the lower suspension member in place. A mounting plate is mounted in the motor casing and securely attached to the upper casing. The mounting plate is securely engaged with a supporting rod around which a motor of a ceiling fan is rotatably mounted.

7 Claims, 8 Drawing Sheets

SUSPENSION ASSEMBLIES FOR CEILING FANS

CROSS-REFERENCE TO RELATED APPLICATION

This is a continuation-in-part application of U.S. patent application Ser. No. 08/885,264 filed on Jun. 30, 1997 now U.S. Pat. No. 5,851,107, issued Dec. 22, 1998.

BACKGROUND OF THE INVENTION

1. Field of the Invention

The present invention relates to an improved suspension assemblies for ceiling fans.

2. Description of the Related Art

U.S. patent application Ser. No. 08/885,264 discloses improved suspension assemblies that may absorb shocks and vibrations of the ceiling fan and to eliminate the potential risk of disengagement of the ceiling fan from the suspension device. It is, however, found that assembly of the motor casing and the suspension seat is troublesome. The present invention is intended to provide an improved design in this regard.

SUMMARY OF THE INVENTION

It is a primary object of the present invention to provide an improved suspension assembly for ceiling fans, wherein a motor casing and a lower retaining seat are integrally formed to save the assembly procedure.

It is another object of the present invention to provide an improved suspension assembly for ceiling fans in which the lower retaining seat includes an inner wave-like surface to simplify structures of a bowl-like section of an upper supporting member and an upper suspension member.

A suspension assembly for ceiling fans in accordance with the present invention comprises an upper supporting device securely attached to a ceiling, a suspension rod means, and a motor casing. The upper supporting device includes a bowl-like upper retaining seat having a bowl-like spherical inner periphery and a through hole extending along a longitudinal axis thereof. The suspension rod means includes a rod, a bowl-like upper suspension member securely mounted to an upper end of the rod and securely retained in the upper retaining seat, and an inverted bowl-like lower suspension member securely mounted to a lower end of the rod. The motor casing includes an upper casing and a lower casing securely attached to the upper casing. The upper casing includes a lower retaining seat integrally formed on an upper part thereof. The lower retaining seat includes an opening in an upper end thereof for securely holding the lower suspension member. The lower retaining seat further includes a wave-like inner surface to retain the lower suspension member in place. A mounting plate is mounted in the motor casing and securely attached to the upper casing. The mounting plate is securely engaged with a supporting rod around which a motor of a ceiling fan is rotatably mounted.

The bowl-like spherical inner periphery of the upper retaining seat includes at least one rib formed thereon, and the bowl-like upper suspension member has at least one engaging groove defined in a spherical outer surface thereof for fittingly receiving said at least one rib.

The inner periphery that defines the opening of the lower retaining seat includes at least one rib formed thereon, and the inverted bowl-like lower suspension member has at least one engaging groove defined in a spherical outer surface thereof for fittingly receiving said at least one rib.

The lower retaining seat includes a cutout and a leaf detachably engaged with the lower retaining seat to cover the cutout. Two edges that define the cutout of the lower retaining seat include two tabs respectively formed thereon, each tab having a hole defined therein. The leaf includes two holes defined therein. Two screws are extended through the holes of the tabs and the leaf to secure the leaf to the lower retaining seat.

The upper supporting device includes a cutout and a leaf detachably engaged with the upper supporting device to cover the cutout.

The mounting plate includes a central threaded hole, and the supporting rod includes a threaded upper end for engaging with the central threaded hole of the mounting plate.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
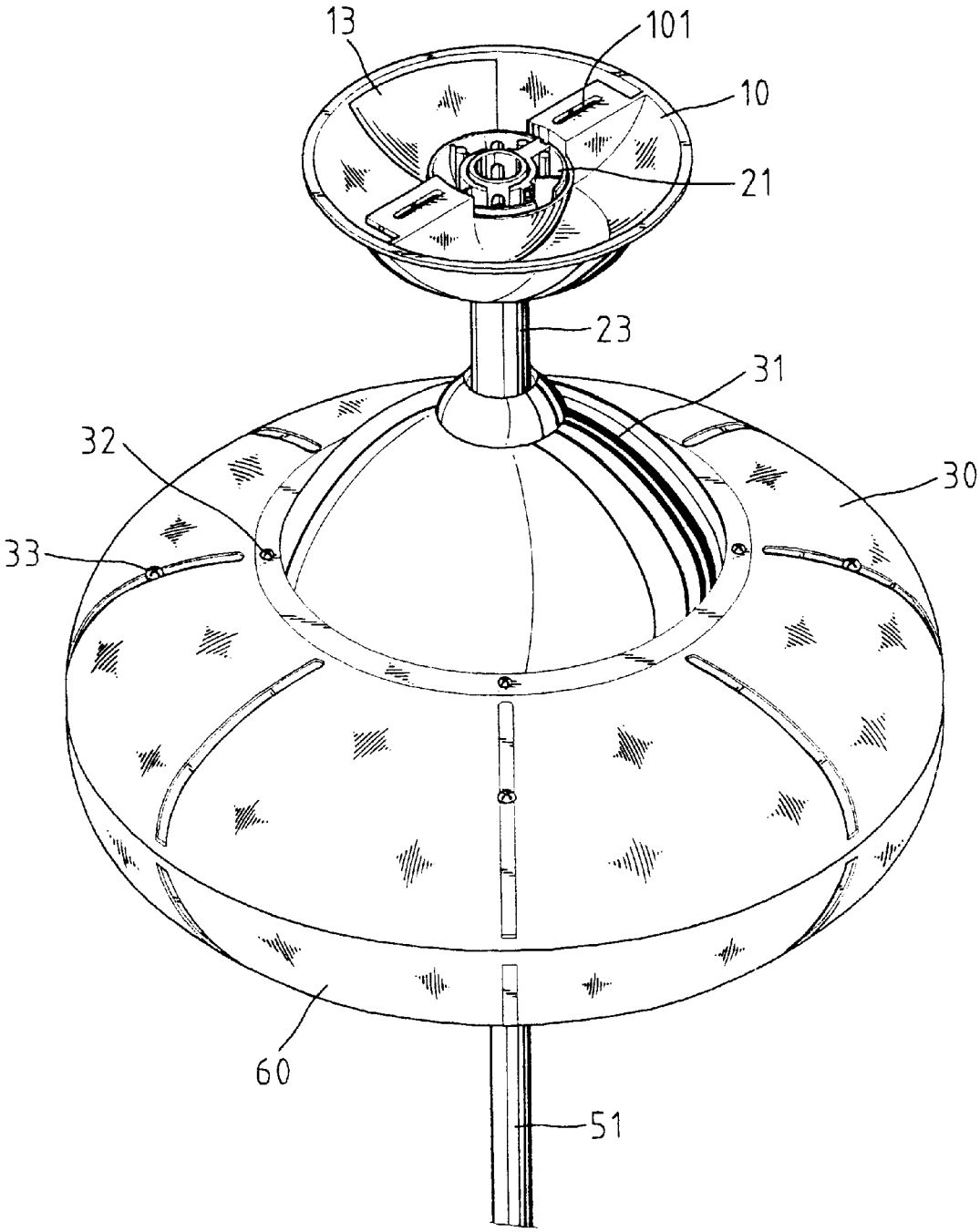
FIG. 1 is a perspective view of a first embodiment of a suspension assembly for ceiling fans in accordance with the present invention.
Figure 2:
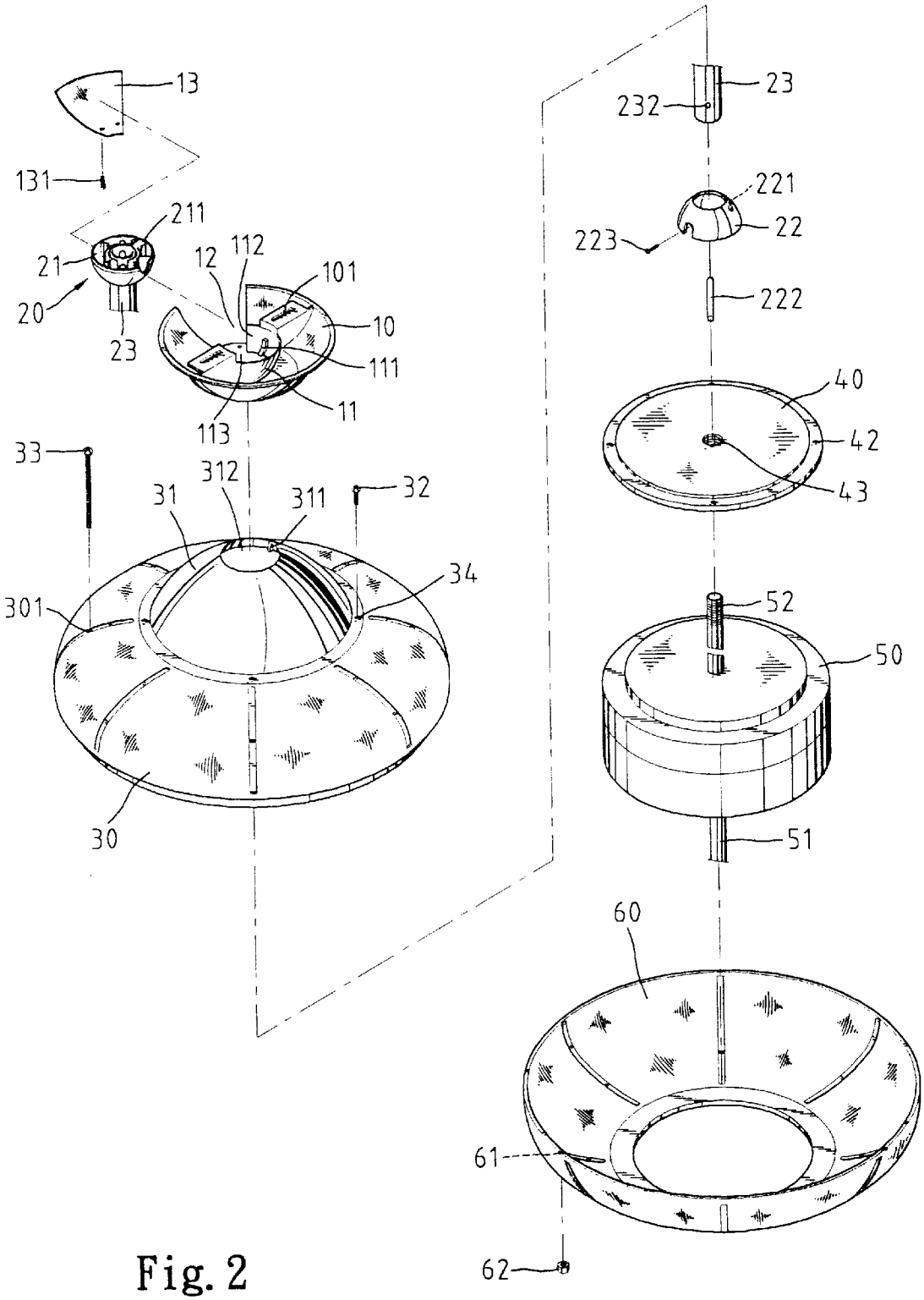
FIG. 2 is an exploded perspective view of the suspension assembly in FIG. 1.
Figure 3:
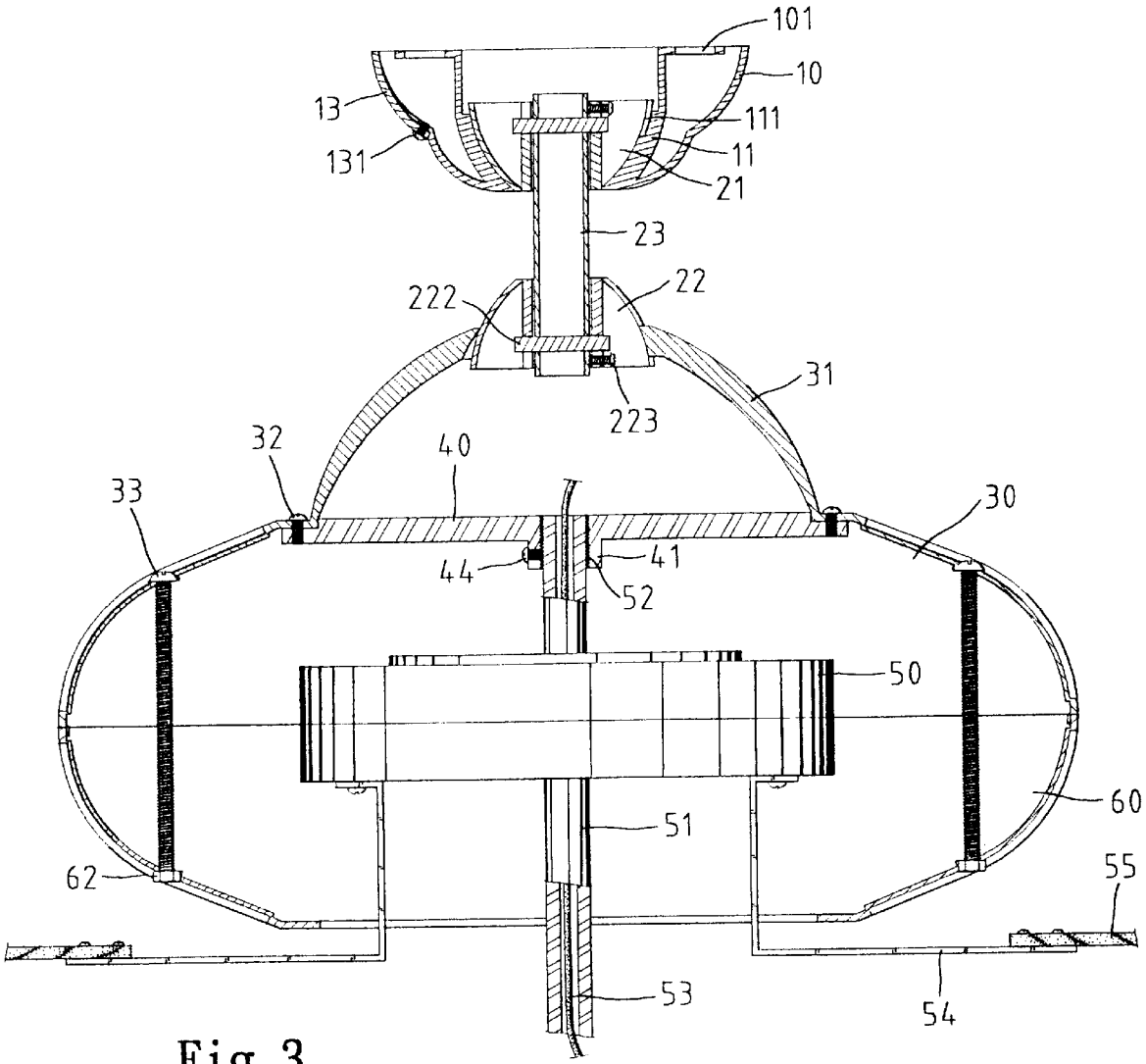
FIG. 3 is a section view of the suspension assembly in FIG. 1.

Referring to the drawings and initially to FIGS. 1 to 3, a first embodiment of a suspension assembly for ceiling fans in accordance with the present invention generally includes an upper supporting device 10 securely attached to a ceiling (not shown) by means of extending screws (not shown) through holes 101 defined therein, a suspension rod means 20, and a motor casing. The upper supporting device 10 includes a bowl-like retaining seat 11 having a bowl-like spherical inner periphery 112 (FIG. 2) and a through hole 113 (FIG. 2) extending along a longitudinal axis thereof. At least one rib 111 is formed on the inner periphery 112 of the bowl-like retaining seat 11. The upper supporting device 10 may include a cutout 12 and a leaf 13 fittingly attached to the supporting device 10 by screws 131 to cover the cutout 12. Provision of the cutout 12 allows easy assembly of the upper suspension member 21. The suspension rod means 20 includes a rod 23, a bowl-like upper suspension member 21 securely attached to an upper end of the rod 23, and an inverted bowl-like lower suspension member 22 securely attached to a lower end of the rod 23.

The bowl-like upper suspension member 21 includes at least one engaging groove 211 defined in a spherical outer surface (not labeled) thereof for engaging with the rib 111 of the upper retaining seat 11 to thereby retain the upper suspension member 21 in position. The lower suspension member 22 includes at least one engaging groove 221 defined in a spherical outer surface (not labeled) thereof. In this embodiment, as shown in FIG. 3, the lower suspension member 22 is securely attached to the lower end of the rod 23 by a pin 222 and is retained in position by a screw 223 that extends through a hole 232 (FIG. 2) defined in a lower end of the rod 23.

The motor casing includes an upper casing 30 having a lower retaining seat 31 integrally formed on an upper part thereof. The lower retaining seat 31 includes an opening 312 (FIG. 2) with an inner periphery (not labeled) for securely engaging with the spherical outer surface of the lower suspension member 22. In addition, the inner periphery of the opening 312 of the lower retaining seat 31 includes at least one rib 311 formed thereon for securely engaging with the engaging groove 221 to retain the lower suspension member 22 in position. The motor casing further includes a lower casing 60 engaged with the upper casing 30. In this embodiment, the upper and lower casings 30 and 60 includes aligned screw holes 301 and 61 through which bolts 33 are extended and nuts 62 are threadedly engaged to the bolts 33 to secure the casings 30 and 60 together.

As shown in FIG. 3, a mounting plate 40 is securely attached to the upper casing 30 by means of extending screws 32 (FIG. 2) through holes 34 defined in the upper casing 30 and holes 42 (see FIG. 2) defined in the mounting plate 40. The mounting plate 40 further includes a threaded hole 43 for threadedly engaging with an upper threaded end 52 of a supporting rod 51 around which a motor 50 is rotatably mounted. The mounting plate 40 further includes a flange 41 formed on an underside thereof. The flange 41 includes a threaded hole (not labeled) aligned with the threaded hole 43 of the mounting plate 40, and a screw 44 is extended through a transverse through hole (not labeled) in the flange 41 to frictionally retain the supporting rod 52 in position. The supporting rod 51 may receive electric wires 53 therein, best shown in FIG. 3. A number of blade supports 54 are attached to the motor 50 to rotate therewith, and each blade support 54 has a blade attached thereto, as shown in FIG. 3, which is conventional and therefore not further described.

In assembly, the upper suspension member 21 of the suspension rod means 20 is inserted into the upper retaining seat 11 via the cutout 12 with the engaging groove 211 engaged with the rib 111. Then, the leaf 13 is attached to fill the cutout 12. The lower suspension member 22 of the suspension rod means 20 is held in the opening 312 of the lower retaining seat 31 with the engaging groove 221 of the lower suspension member 22 engaged with the rib 311 of the lower retaining seat 31. Thus, when the motor 50 rotates, the motor a upper casing 30 and the suspension device 10 shall not rotate due to provision of the suspension rod means 20. Screws 32 are then used to fix the mounting plate 40 for subsequent assembly of the motor 50 to the mounting plate 40. Finally, bolts 33 and nuts 62 are used to secure the upper and lower casings 30 and 60 together.

Figure 4:
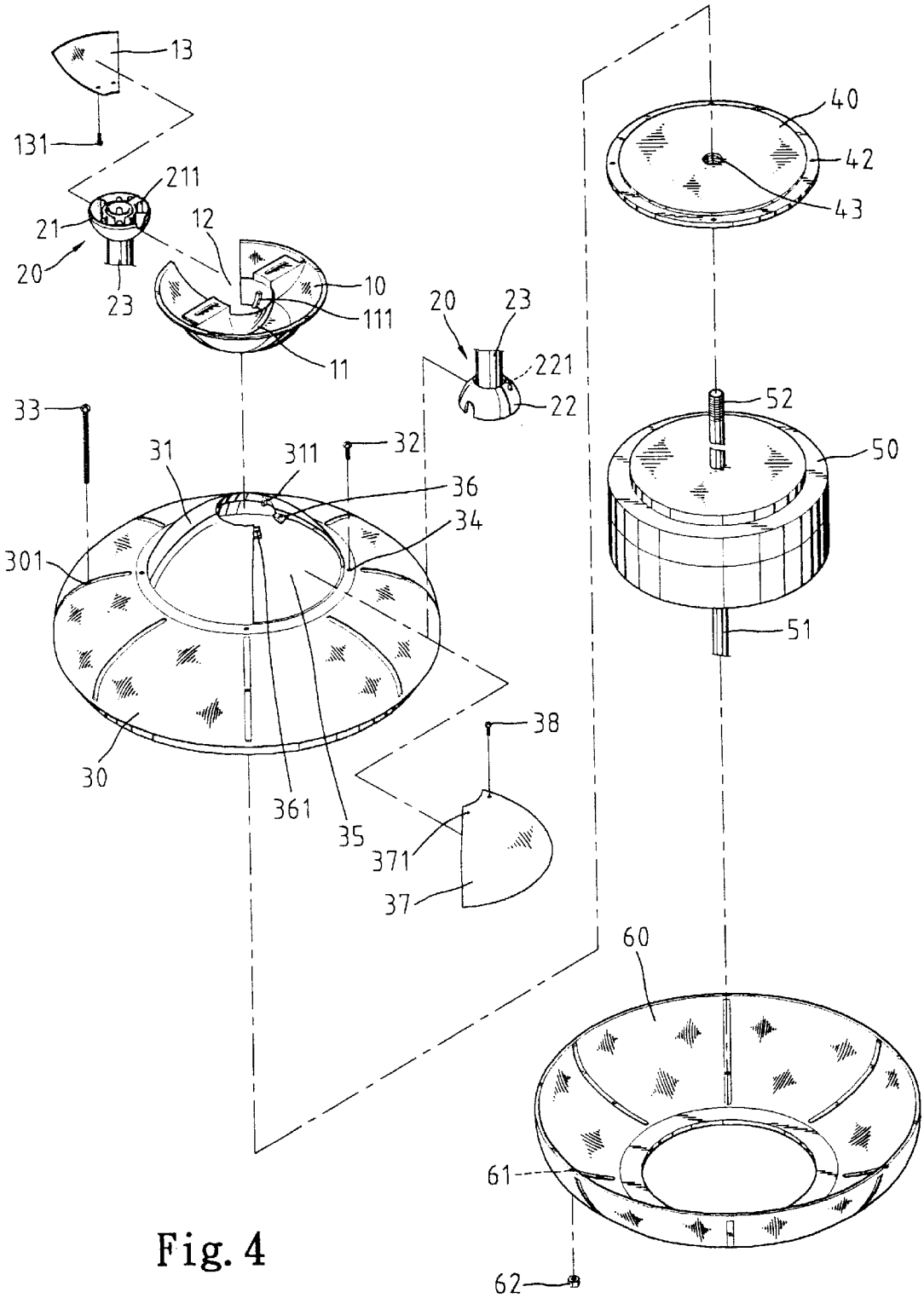
FIG. 4 is an exploded perspective view of a modified embodiment of the suspension assembly in FIG. 2.

FIG. 4 illustrates a modified embodiment of the invention, in which the lower retaining seat 31 includes a cutout 35 and a leaf 37 for covering the cutout 35. In this embodiment, the lower retaining seat 31 includes two tabs 36 respectively formed on two edges that define the cutout 35. Screws 38 are extended through the holes 371 defined in the leaf 37 and holes 361 defined in the tabs 36. This allows easy assembly of the lower suspension member 22 to the lower retaining seat 31.

Figures 5, 5A:
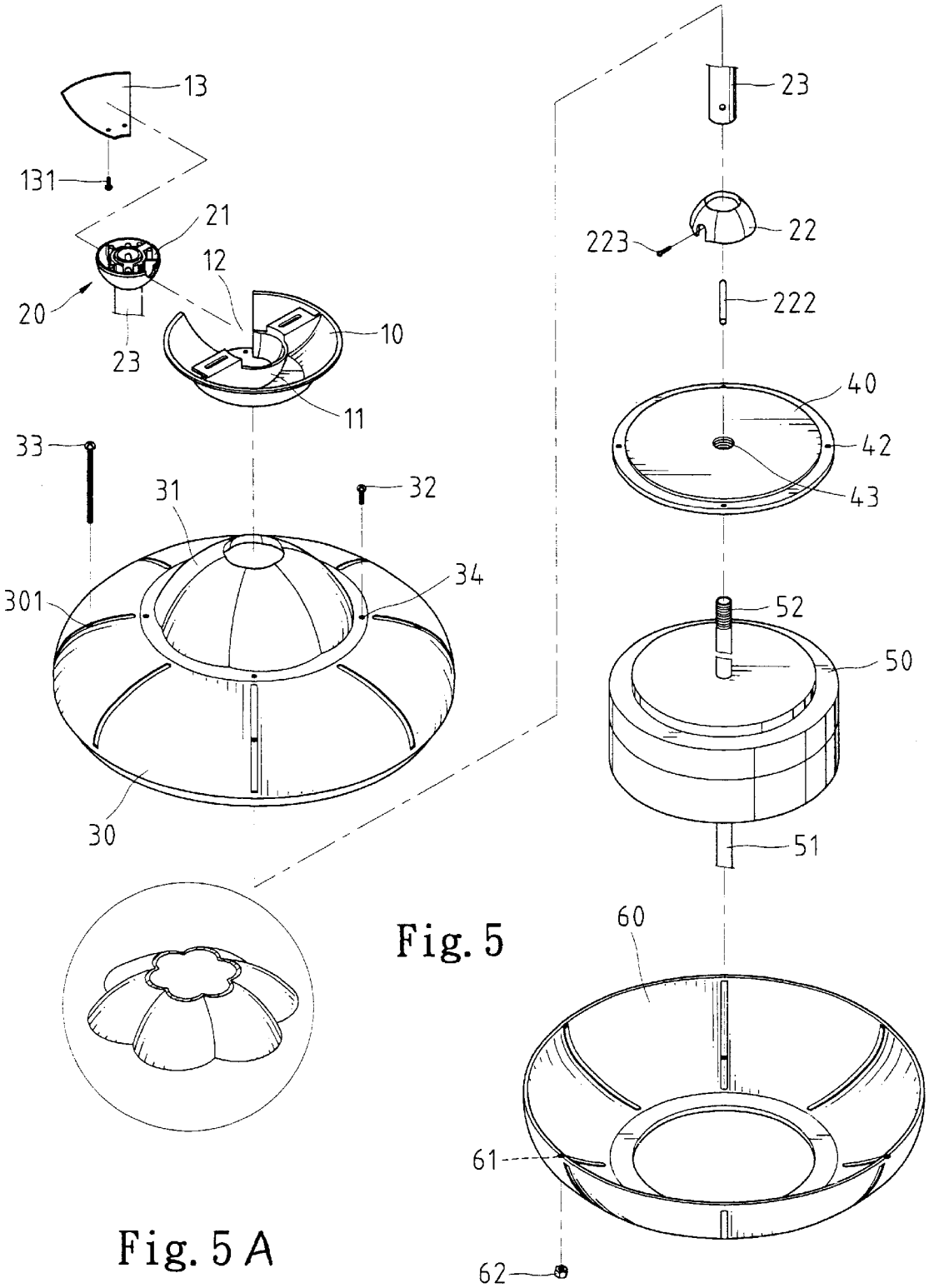
FIG. 5 is an exploded perspective view of a second embodiment of the suspension assembly for ceiling fans in accordance with the present invention.
FIG. 5A is an isometric view showing a wave-like surface of a retaining seat.
Figure 6:
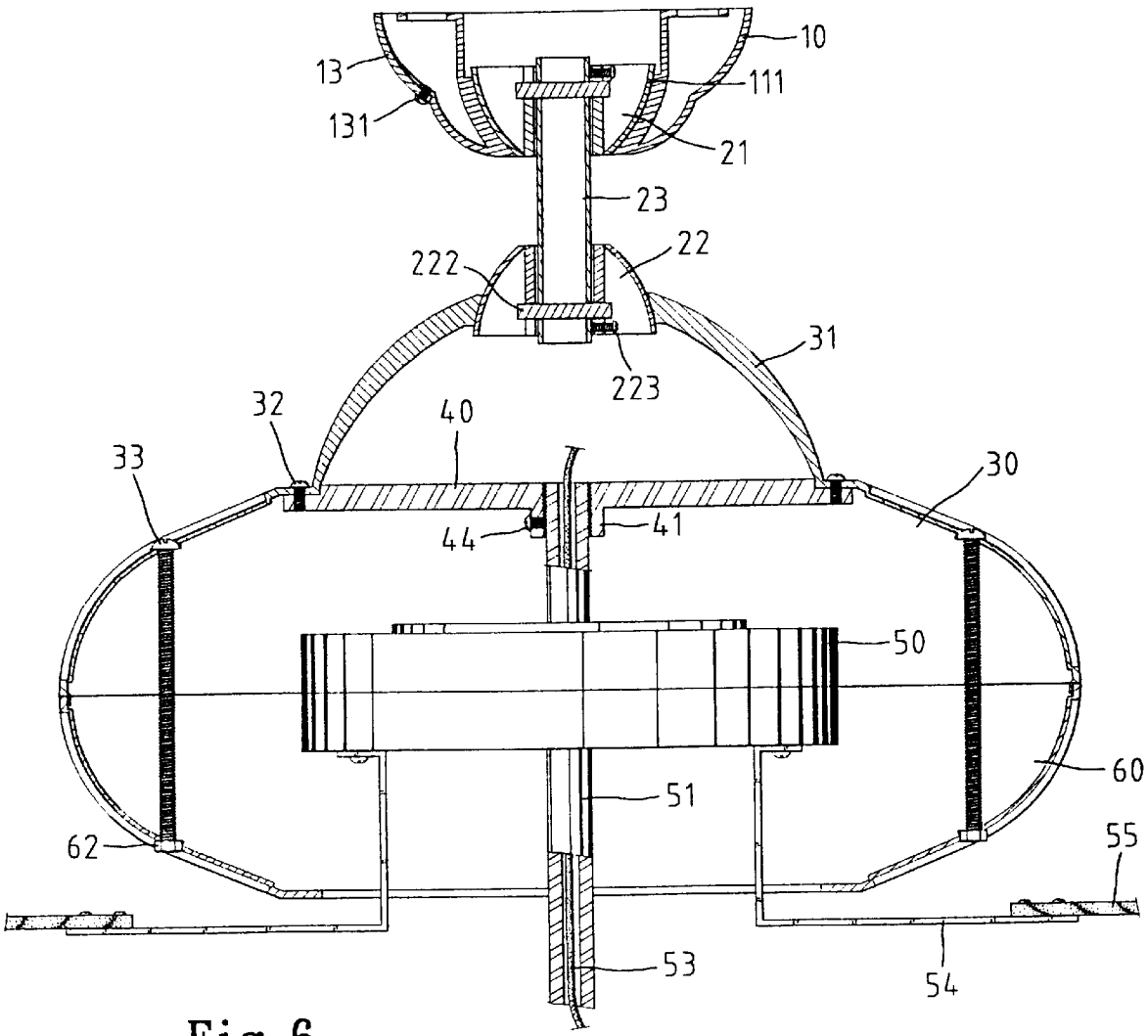
FIG. 6 is a sectional view of the suspension assembly in FIG. 5.

FIGS. 5 and 6 illustrate a second embodiment of the invention, in which the lower retaining seat 31 includes wave-like inner and outer surfaces. The wave-like inner surface of the lower retaining seat 31 shown in FIG. 5A may prevent from rotational movement of the lower suspension member 22. Thus, the engaging groove 211 of the upper suspension member 21 and the rib 111 on the upper retaining seat 11 can be omitted (c.f. FIG. 2).

Figure 7:
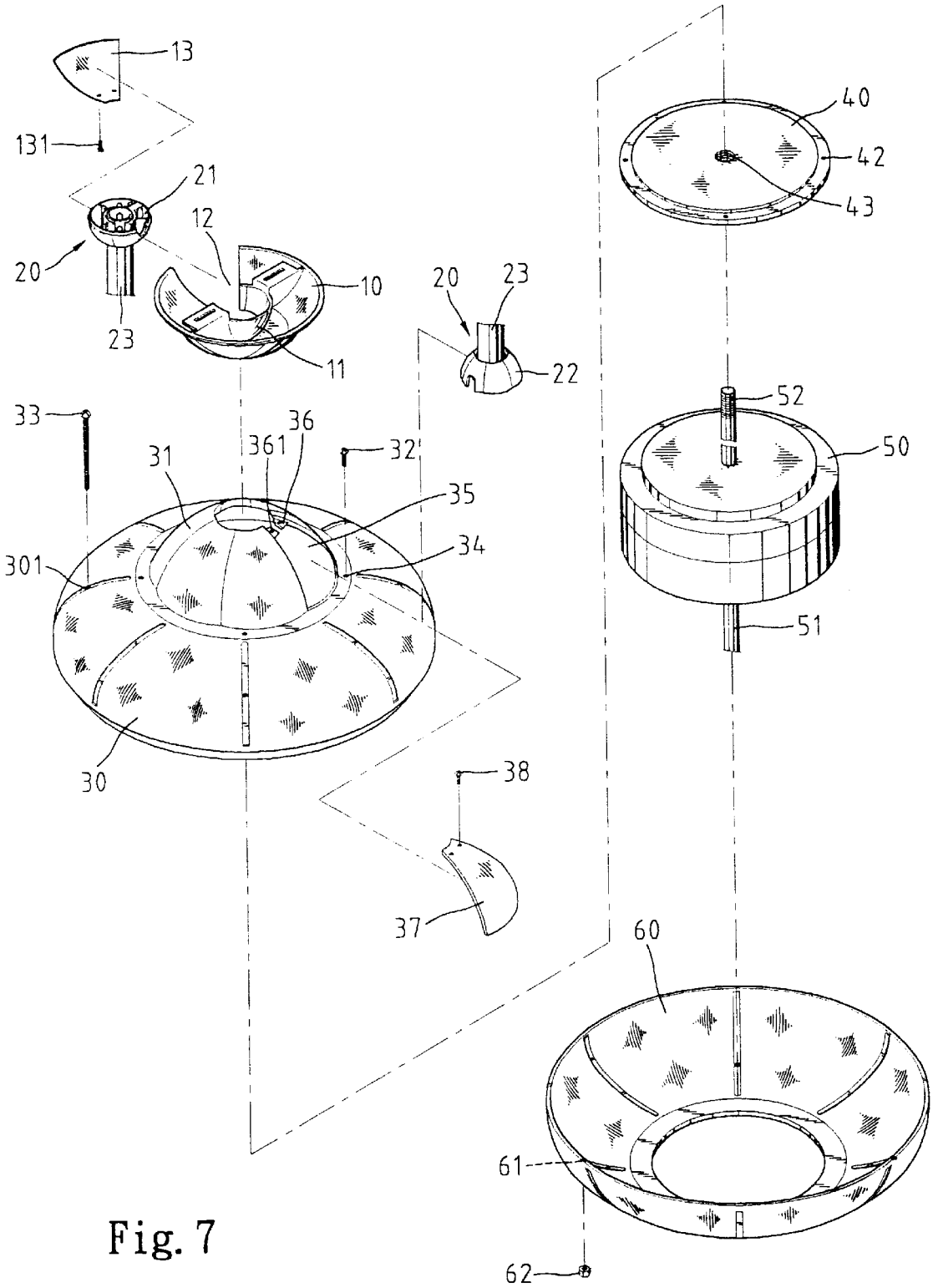
FIG. 7 is an exploded perspective view of a modified embodiment of the suspension assembly in FIG. 5.
Figure 8:
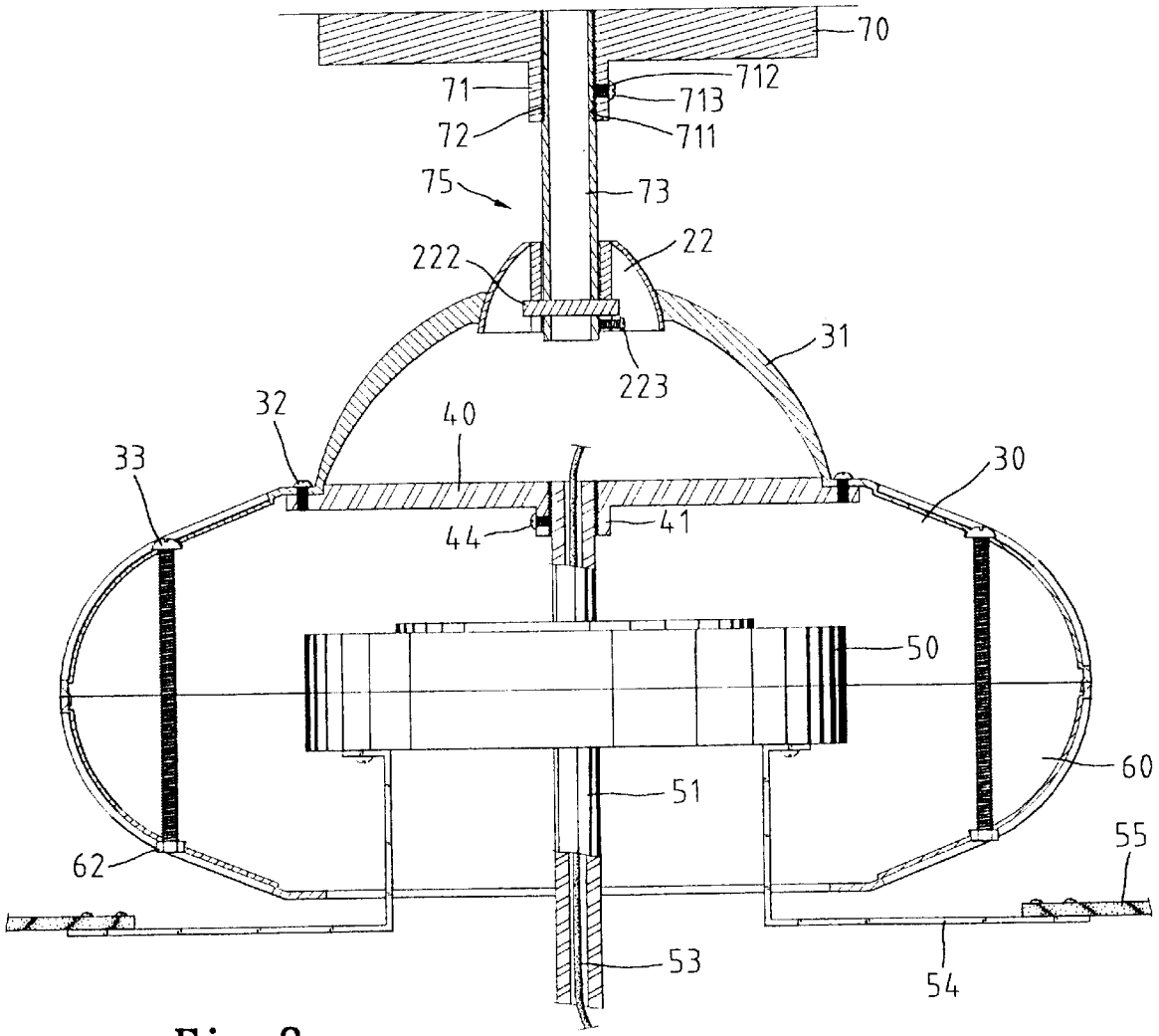
FIG. 8 is a sectional view of the suspension assembly in FIG. 7.

FIGS. 7 and 8 illustrate a modified embodiment of the second embodiment of the invention, in which, similar to the modified embodiment of the first embodiment, the lower retaining seat 31 includes a cutout 35 and a leaf 37 for covering the cutout 35. In this embodiment, the lower retaining seat 31 includes two tabs 36 respectively formed on two edges that define the cutout 35. Screws 38 are extended through the holes 371 defined in the leaf 37 and holes 361 defined in the tabs 36. This allows easy assembly of the lower suspension member 22 to the lower retaining seat 31.

According to the above description, it is appreciated that shocks and vibrations generated during operation of the ceiling fan can be effectively absorbed under provision of the upper and lower suspension members 21 and 22. As a result, the ceiling fan will not vibrate or waive, and the service life thereof is longer. Further, the upper and lower suspension members 21 and 22 may act as two standard adjusting means to adjust vertical extending direction of the ceiling fan and thus allows the ceiling fan to be mounted to an inclined ceiling. In addition, the upper motor casing 30 is improved in structural strength thereof as it is integral with the upper retaining seat 31. Further, the suspension device 10 and the lower retaining seat 31 may have cutouts 12 and 35 to allow easy assembly of the suspension rod means 20. The wave-like inner surface of the lower retaining seat 31 further enhances the shock-absorbing effect and vibration-absorbing effect.

Although the invention has been explained in relation to its preferred embodiment, it is to be understood that many other possible modifications and variations can be made without departing from the spirit and scope of the invention as hereinafter claimed.

What is claimed is:

1. A suspension assembly for ceiling fans, comprising:

an upper supporting device (10) adapted to be securely attached to a ceiling, the upper supporting device (10) including a bowl-like upper retaining seat (11) having a bowl-like spherical inner periphery (112) and a through hole (113) extending along a longitudinal axis thereof, a suspension rod means (20) including a rod (23) having an upper end and a lower end, a bowl-like upper suspension member (21) securely mounted to the upper end of the rod (23) and securely retained in the upper retaining seat (11), and an inverted bowl-like lower suspension member (22) securely mounted to the lower end of the rod (23), a motor casing including an upper casing (30) and a lower casing (60) securely attached to the upper casing (30), the upper casing (30) including a lower retaining seat (31) integrally formed on an upper part thereof, the lower retaining seat (31) including an opening (312) in an upper end thereof for securely holding the lower suspension member (22), the lower retaining seat (31)

further including a wave-like inner surface to retain the lower suspension member (22) in place, and a mounting plate (40) mounted in the motor casing and securely attached to the upper casing, the mounting plate (40) being adapted to be securely engaged with a supporting rod (51) around which a motor (50) of a ceiling fan is rotatably mounted.

2. The suspension assembly for ceiling fans according to claim 1, wherein the bowl-like spherical inner periphery of the upper retaining seat (11) includes at least one rib (111) formed thereon, and the bowl-like upper suspension member (21) has at least one engaging groove (211) defined in a spherical outer surface thereof for fittingly receiving said at least one rib (111).

3. The suspension assembly for ceiling fans according to claim 1, wherein the inner periphery that defines the opening (312) of the lower retaining seat (31) includes at least one rib (311) formed thereon, and the inverted bowl-like lower suspension member (22) has at least one engaging groove (221) defined in a spherical outer surface thereof for fittingly receiving said at least one rib (311).

4. The suspension assembly for ceiling fans according to claim 1, wherein the lower retaining seat (31) includes a cutout (35) and a leaf (37) detachably engaged with the lower retaining seat to cover the cutout (35).

5. The suspension assembly for ceiling fans according to claim 4, wherein two edges that define the cutout (35) of the lower retaining seat (31) include two tabs (36) respectively formed thereon, each said tab having a hole (361) defined therein, the leaf (37) including two holes (371) defined therein, and further comprises two screws (38) extended through the holes (371 and 361) to secure the leaf (37) to the lower retaining seat (31).

6. The suspension assembly for ceiling fans according to claim 1, wherein the upper supporting device (10) includes a cutout (12) and a leaf (13) detachably engaged with the upper supporting device (10) to cover the cutout (12).

7. The suspension assembly for ceiling fans according to claim 1, wherein the mounting plate (40) includes a central threaded hole (43), and the supporting rod (51) includes a threaded upper end (52) for engaging with the central threaded hole (43) of the mounting plate (40).

* * * * *